United States Patent [19]

Takao et al.

[11] Patent Number: 4,580,536

[45] Date of Patent: Apr. 8, 1986

[54] CONTROL APPARATUS OF AN INTAKE AIR AMOUNT IN AN INTERNAL COMBUSTION ENGINE

[75] Inventors: Mitsunori Takao, Kariya; Takahiko Kimura, Nagoya, both of Japan

[73] Assignee: Nippondenso Co., Ltd., Kariya, Japan

[21] Appl. No.: 719,959

[22] Filed: Apr. 4, 1985

[30] Foreign Application Priority Data

Apr. 11, 1984 [JP] Japan ..... 59-73724

[51] Int. Cl.[4] ..... F02M 3/07

[52] U.S. Cl. ..... 123/339; 123/585

[58] Field of Search ..... 123/339, 585

[56] References Cited

U.S. PATENT DOCUMENTS 4,397,275 8/1983 Itoh et al. ..... 123/339

FOREIGN PATENT DOCUMENTS 146248 11/1980 Japan ..... 123/339

126534 8/1982 Japan .

*Primary Examiner*—Tony M. Argenbright

*Attorney, Agent, or Firm*—Cushman, Darby & Cushman

[57] ABSTRACT

An intake pipe of an internal combustion engine is formed with an air passageway so as to bypass a throttle valve portion and an air control valve to control the amount of the air flowing through this passageway is provided for this air passageway. This control valve is constituted so as to drive an actuator in accordance with the amount of an exciting current and thereby to control the amount of the air which flows through this passageway. An exciting coil of this control valve is heated and controlled by the cooling water of the internal combustion engine. When the internal combustion engine is in the idle operation state and also in the feedback control state, the temperature of the cooling water is detected. In the case where this temperature falls within a specified range, a correction value of a control amount for feedback control to allow the present rotating speed of the internal combustion engine to approach the idle objective rotating speed is calculated and stored. A control amount for open loop control subsequent to this feedback control state is calculated on the basis of this correction value stored.

8 Claims, 8 Drawing Figures

FIG. 1A
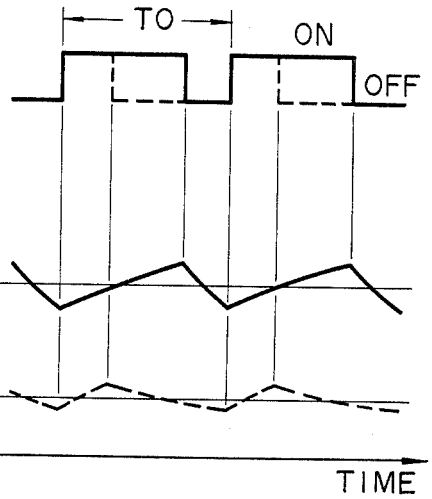
FIG. 1B
FIG. 1C
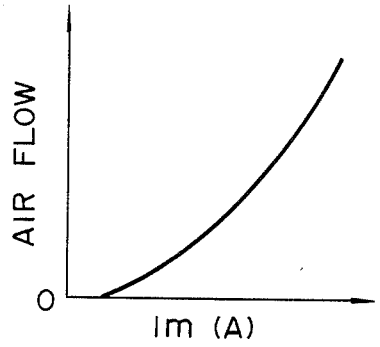

CONTROL APPARATUS OF AN INTAKE AIR AMOUNT IN AN INTERNAL COMBUSTION ENGINE

BACKGROUND OF THE INVENTION

The present invention relates to a control apparatus for controlling the amount of air which is sucked into an internal combustion engine in accordance with the operation state of the engine and, more particularly, to means for controlling the amount of air flowing through a bypass air passageway, which is arranged in parallel to an intake pipe, to allow the intake air of an internal combustion engine to pass.

A throttle valve, which is driven and controlled by an accelerator pedal, is set in the intake pipe for feeding air into an internal combustion engine. The amount of intake air into an internal combustion engine is controlled by the opening state of that throttle valve. On one hand, in the idle state where the foregoing throttle valve portion is bypassed and the throttle valve is controlled so as to be closed, the intake air into the internal combustion engine is supplied through the foregoing bypass air passageway.

In this case, an air amount control valve as shown in, for instance, Japanese Patent Application Laid-Open No. 126534/1982 is set in the bypass air passageway and the amount of intake air into the internal combustion engine is controlled by this control valve.

When an internal combustion engine is idling, a feedback control is executed such that its rotating speed is set to a preset idle objective rotating speed. This objective rotating speed is set due to the temperature of the cooling water for the engine or the like. Namely, the opening of the air amount control valve provided in the bypass air passageway is feedback controlled to control the amount of intake air so that the engine is rotated and controlled at that objective rotating speed.

The control state of the air amount control valve includes the feedback loop control, whereby the rotating speed of the engine is controlled to become the objective rotating speed and the open loop control whereby such a control is not executed. Either one of those control states is selected in accordance with the operating state of the engine. In this case, when the control state is switched from the open loop control to the feedback loop control, it is necessary to set the control amount in the open loop control state so that the rotating speed of the engine smoothly reaches its objective rotating speed. Therefore, the feedback control amount which varies due to a time change in engine friction, choke of the air passageway, or the like is learned and this learned control amount is reflected to the open loop control.

As the control valve for controlling the amount of intake air, an electromagnetic valve mechanism of the linear solenoid type which can variably control a cross sectional area of the air passageway (by way of the control of its current), is used. The current which is supplied to an exciting coil of this control valve is constituted by, for example, a pulse-like signal due to a square wave, which is generated at every specific period $T_0$ as shown in FIG. 1A. Its current is set by an effective time width of the square wave signal, namely, duty ratio. The amount of air which passes is variably controlled due to the foregoing current.

Practically speaking, for the control currents of duties as shown respectively by a solid line and a broken line in FIG. 1A, their respective mean currents Im1 and Im2 are as shown by a solid line and a broken line in FIG. 1B. The relation between this mean current Im and the air flow rate which is controlled is as shown in FIG. 1C.

However, this mean current Im varies in accordance to the magnitude of the duty ratio, as mentioned above, and the temperature of the exciting coil for driving the air control valve. Practically speaking, even in the case of a pulse-like control current which is set to the same duty ratio, if the temperature of the foregoing coil is low, an electrical resistance value of this coil is small, so that its mean current value becomes large. On the contrary, when the coil temperature is high, its electrical resistance value is large and its mean current value is small.

Therefore, if one desires to determine the amount of intake air into an internal combustion engine due to the learning control by use of such an air flow rate control valve, the control amount in the learned feedback control state does not always become the amount which was set in correspondence to the foregoing time change, and the control amount in the open loop control state does not become the proper amount.

SUMMARY OF THE INVENTION

It is an object of the present invention to allow the control of an internal combustion engine to be smoothly executed and, more particularly, to provide a control apparatus of the amount of intake air into an internal combustion engine in which the control of the amount of air flowing through an air passageway formed in a throttle valve portion so as to bypass this valve is executed with a high degree of accuracy due to the learning control.

Another object of the invention is to provide an air control apparatus in which, in the case of using an air control valve which supplies an exciting current to an exciting coil to control the foregoing bypass air passageway and allows the air amount control (responsive to this current) to be executed, the rotating speed of an internal combustion engine is controlled and set to an objective rotating speed with a high degree of accuracy without being affected by a change in temperature or the like.

Still another object of the invention is to control the amount of air which bypasses a throttle valve on the basis of a control amount in the feedback control state in a manner such that a control amount in the open loop control is definitely executed, due to the learned control, and the control of the operation of an internal combustion engine, particularly, in the idle operation state is smoothly executed.

Namely, in an intake air control apparatus of an internal combustion engine according to the present invention, an air control valve (whose opening is controlled in accordance with the amount of exciting current) is set in the air passageway so as to bypass the throttle valve portion of an intake pipe, and temperature detecting means for detecting the temperature state of an exciting coil of this air control valve is set in the portion corresponding to this coil. When the temperature of the coil detected by the temperature detecting means is in the specified temperature state, from the control amount of the feedback control to set the actual rotating speed of the internal combustion engine to idle at an objective rotating speed, a correction value to derive this control amount is calculated and stored. The control amount in the open loop control state is calculated using this stored correction value.

Therefore, the control amount in the open loop control state is set and controlled on the basis of the control amount in the feedback control state when the exciting coil of the air control valve is in the specified temperature range. For instance, it is possible to prevent the execution of the open loop control if the learned value has been based on the wrong correction value, due to the affect of the temperature if the exciting coil is in a special temperature state, e.g., in a particularly low temperature range. The correction value based on the proper control amount is always reflected to the open loop control. The control of the intake air amount in accordance with the operation state of an internal combustion engine is executed. The control of the operation of this internal combustion engine is smoothly executed.

BRIEF DESCRIPTION OF THE DRAWINGS

FIG. 1A is a diagram showing the states of drive currents to drive an air amount control valve to control an intake air passageway which is set so as to bypass a throttle valve;

FIG. 1B is a diagram showing the states of the mean currents corresponding to the foregoing drive currents;

FIG. 1C is a diagram showing the relationship between the foregoing mean current and the amount of air flowing through the air passageway;

DETAILED DESCRIPTION OF THE PREFERRED EMBODIMENT

Figure 2:
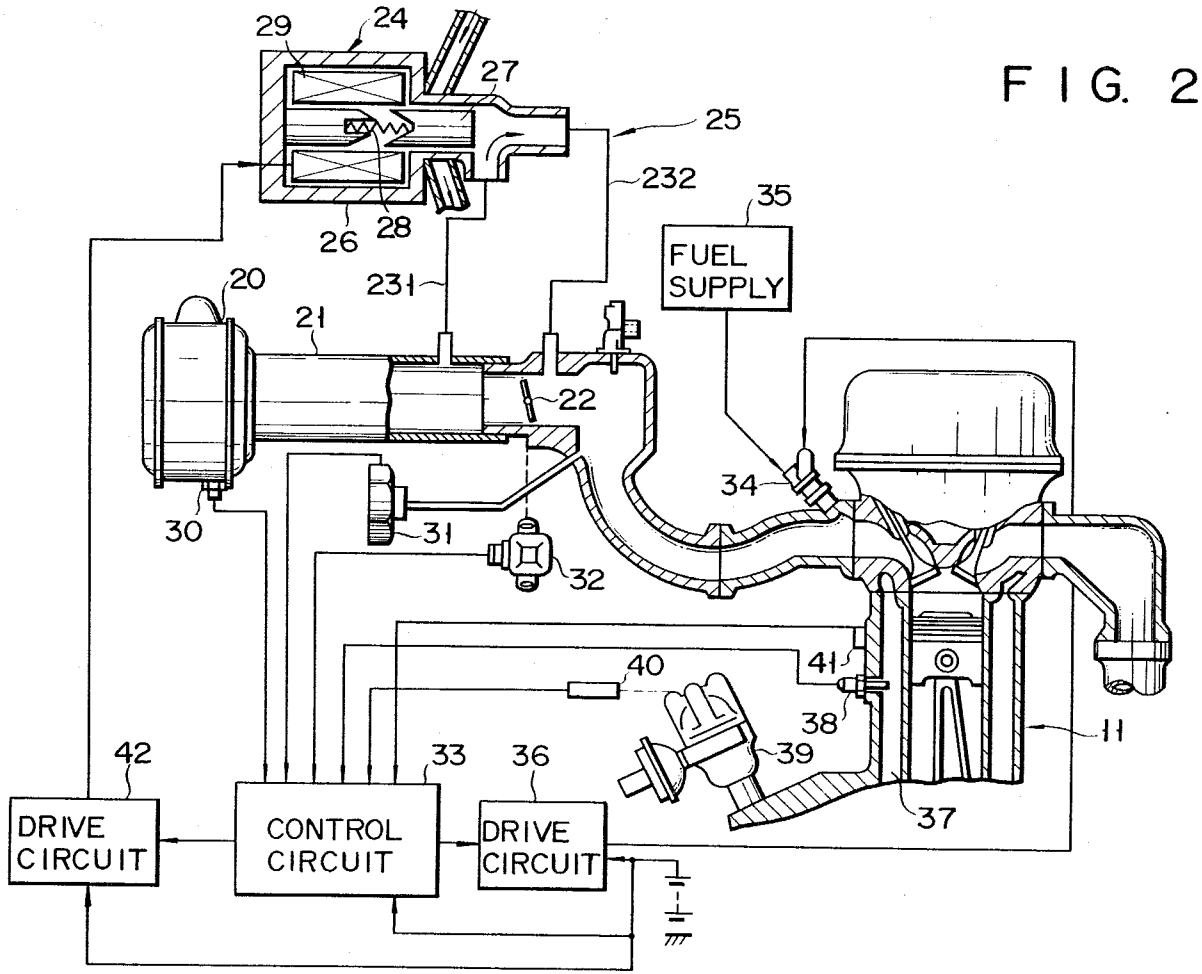
FIG. 2 is an arrangement diagram for explaining an engine control system using a control apparatus for an amount of air according to one embodiment of the present invention.

FIG. 2 is a diagram for explaining an electronic control system including the control of fuel injection amount to an engine 11 installed in a motor vehicle. The air is inhaled into the engine 11 through an air cleaner 20 and an intake pipe 21. A throttle valve 22, which is driven and controlled by an accelerator pedal, is provided for the intake pipe 21. Air of the amount corresponding to the opening of the throttle valve 22 is inhaled into the engine 11.

Pipings 231 and 232 are formed for the intake pipe 22 so that they are branched to the upstream and downstream sides of the throttle valve 22, respectively. These pipings 231 and 232 can be coupled by an air control valve 24. An air passageway 25 is formed so as to bypass the throttle valve 22. The amount of air flowing through the bypass air passageway 25 is controlled by the opening of the air control valve 24.

The air control valve 24 is equipped with an actuator 27 which is constituted by a plunger which is movable in a housing 25. The actuator 27 is arranged so as to close the connection portion of the pipings 231 and 232 by a spring 28 adapted to be compressed. When an exciting current is supplied to an exciting coil 29, the actuator 27 is controlled in such a way that it is moved against a spring 28 and connects the pipings 231 and 232, thereby allowing the air to flow through the bypass air passageway 25. The amount of this air is controlled by the exciting current.

Figure 3:
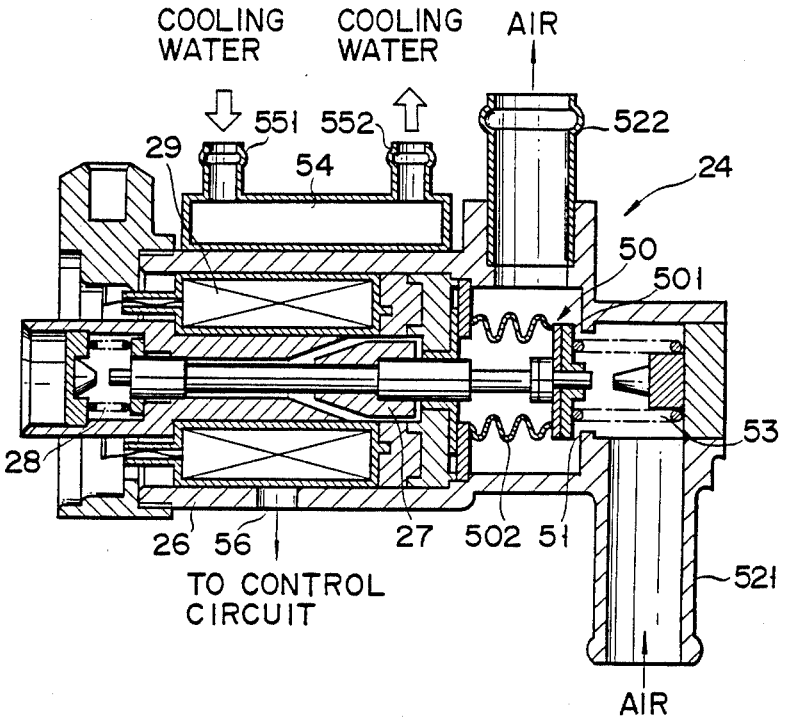
FIG. 3 is a cross sectional view showing a practical arrangement of an air control valve for use in the engine control system shown in FIG. 2.

FIG. 3 shows the air amount control valve 24 further in detail. A valve mechanism 50 is attached to the actuator 27. The valve mechanism 50 consists of a valve 501 and a bellows 502 and is constituted in a manner such that the valve 501 comes into contact with a pedestal 51 when the actuator 27 is set into the protruding state by the spring 28 and thereby closing the portion between ports 521 and 522 which are respectively connected to the pipings 231 and 232. When the exciting current is supplied to the exciting coil 29, the actuator 27 is driven in the direction so as to detach the valve 501 from the pedestal 51, so that the pipings 231 and 232 are communicated. In addition to the spring 29, a spring 53 which opposes the spring 28 is provided for the actuator 27. The actuator 27 is held by the springs 28 and 53. The relation in force between the springs 28 and 53 is set so that the valve 501 is held in contact with the pedestal 51 in the state such that no force acts from the outside. When the exciting current is supplied to the exciting coil 29, the valve 501 is driven so that it is detached from a pedestal 52 and is located at the position corresponding to the amount of that exciting current.

A cooling water casing 54 like a pipe is attached to the outside of the housing 26 of the control valve 24 constituted as described above. The cooling water of the engine 11 is circulated through pipings 551 and 552 into the casing 54, thereby setting the temperature of the exciting coil 29 of the control valve 24 into the state corresponding to the temperature of the cooling water of the engine.

The intake air system including the intake pipe 21 is provided with an intake air temperature sensor 30 and an intake air negative-pressure sensor 31. Further, the throttle valve 22 is provided with a throttle position sensor 32 which outputs a signal corresponding to the opening state thereof. Detection signals from those sensors 30 to 32 corresponding to the operation control state of the engine 11 are supplied to a control circuit 33 which is constituted by a microcomputer.

A fuel injection valve 34 is provided in the intake port portion of each cylinder of the engine 11. The fuel, whose pressure was set, is supplied from a fuel supply source 35 to each of the fuel injection valves 34. Namely, signals of time widths corresponding to the fuel injection amount are supplied from the control circuit 33 to a drive circuit 36. The opening operations of the respective fuel injection valves 34 are controlled in accordance with the foregoing time widths and injection times by the drive circuit 36. Fuel of the amounts calculated by the control circuit 33 is injected into the respective cylinders of the engine 11.

A cooling water passageway 37 is formed in the engine block constituting the engine 11. The cooling water passageway 37 is provided with a cooling water temperature sensor 38 to detect the temperature of the cooling water flowing therein. Although not shown in particular in this diagram, the pipings 551 and 552 of the air control valve 24 are connected to the inlet and outlet portions of the cooling water of the cooling water passageway 37, thereby allowing the cooling water to also be circulated into the portion of the control valve 24.

Namely, the cooling water of the engine 11 is led to the portion of the control valve 24. An increase in the temperature of the exciting coil 29 of the control valve 24 is suppressed by this cooling water. The temperature change of the exciting coil 29 is propagated through the housing 26 to the cooling water. Thus, the temperature of the exciting coil 29 is substantially detected by the cooling water temperature sensor 38. A detection signal from the cooling water temperature sensor 38 is supplied to the control circuit 33.

A rotation angle sensor 40 is set to a cam shaft of a distributor 39 which is driven synchronously with the rotation of the engine 11. An angle detection signal is outputted for every half rotation of this cam shaft and is supplied as a rotation angle signal of the engine 11 to the control circuit 33.

The control circuit 33 calculates the engine control information such as the fuel injection amount or the like in correspondence to the operation state of the engine 11, thereby controlling the fuel injection valves 34. On one hand, a bypass air amount signal is supplied to a drive circuit 42 and the amount of exciting current to the exciting coil 29 of the air control valve 24 is controlled by this drive circuit 42, thereby controlling the amount of intake air.

In this case, the control current which is supplied to the exciting coil 29 of the air control valve 24 is constituted by a square-wave like pulse signal which is periodically generated. The control current amount is set due to the effective time width of this pulse-like signal, namely, duty ratio.

Figure 4:
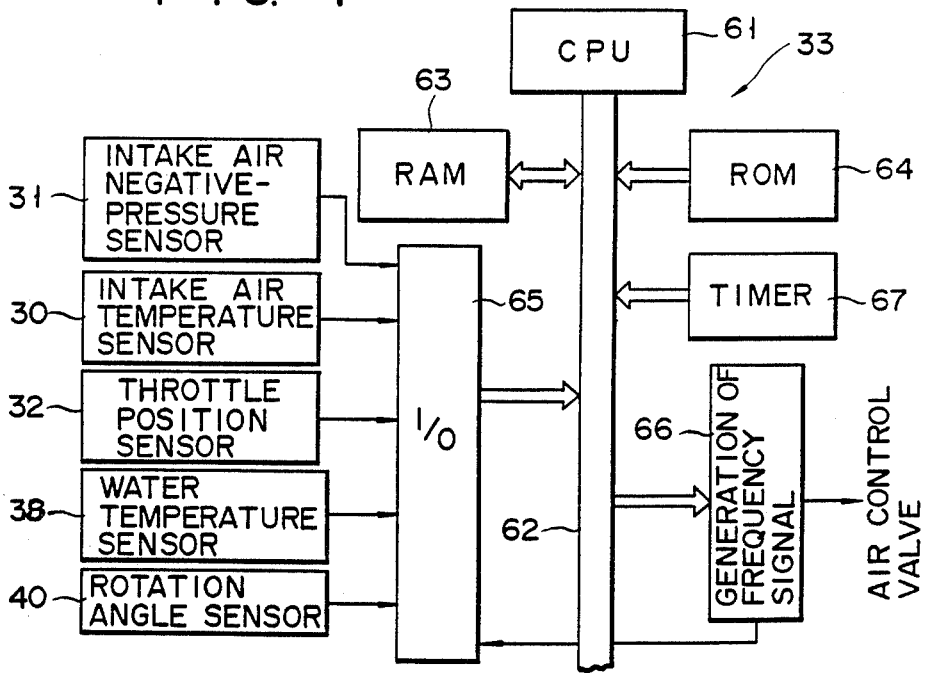
FIG. 4 is a diagram for explaining an example of a control circuit to control the foregoing air control valve.

FIG. 4 shows an arrangement of the control circuit 33 for use in the control system of the engine 11 as mentioned above. This control circuit 33 has a CPU 61 to perform an arithmetic operation control. A system bus 62 such as a data bus, address bus, control bus and the like is connected to the CPU 61. The CPU 61 executes reception and transmission of data through the system bus 62 with a RAM 63, a ROM 64, an input circuit 65, and a frequency signal generator 66, respectively.

The detection signals can be supplied to the input circuit 65 from the intake air temperature sensor 30, intake air negative-pressure sensor 32, throttle position sensor 32, cooling water temperature sensor 38, rotation angle sensor 40, etc., shown in FIG. 2. These detection signals are properly converted to digital signals and are taken in in accordance with a program stored in the ROM 64 and are transmitted as data for operations to the CPU 61.

A timer 67 generates a clock signal to drive and control the control circuit 33 and also generates a timing signal to execute the processing operation.

The exciting current which is applied to the exciting coil 29 of the air control valve 24 in response to such a command of the control circuit 33 is the pulse-like signal which is controlled due to the duty ratio as shown in FIG. 1A. A command signal which is supplied from the control circuit 33 to the drive circuit 42 is a pulse-like frequency signal which is controlled due to the duty ratio. By enlarging the duty ratio, which is the current supplying time ratio of one period $T_0$ of such a frequency signal, the mean current Im1 is increased as shown by the solid line in FIG. 1B. The air control valve 24 is controlled such that the area of the air passageway is made large in response to the value of the mean current. On the contrary, in the case where the duty ratio is made small as indicated by the broken line in FIG. 1A, the mean current Im2 is reduced as shown by the broken line in FIG. 1B, thereby causing the area of the air passageway of the control valve 24 to become small.

Figure 5:
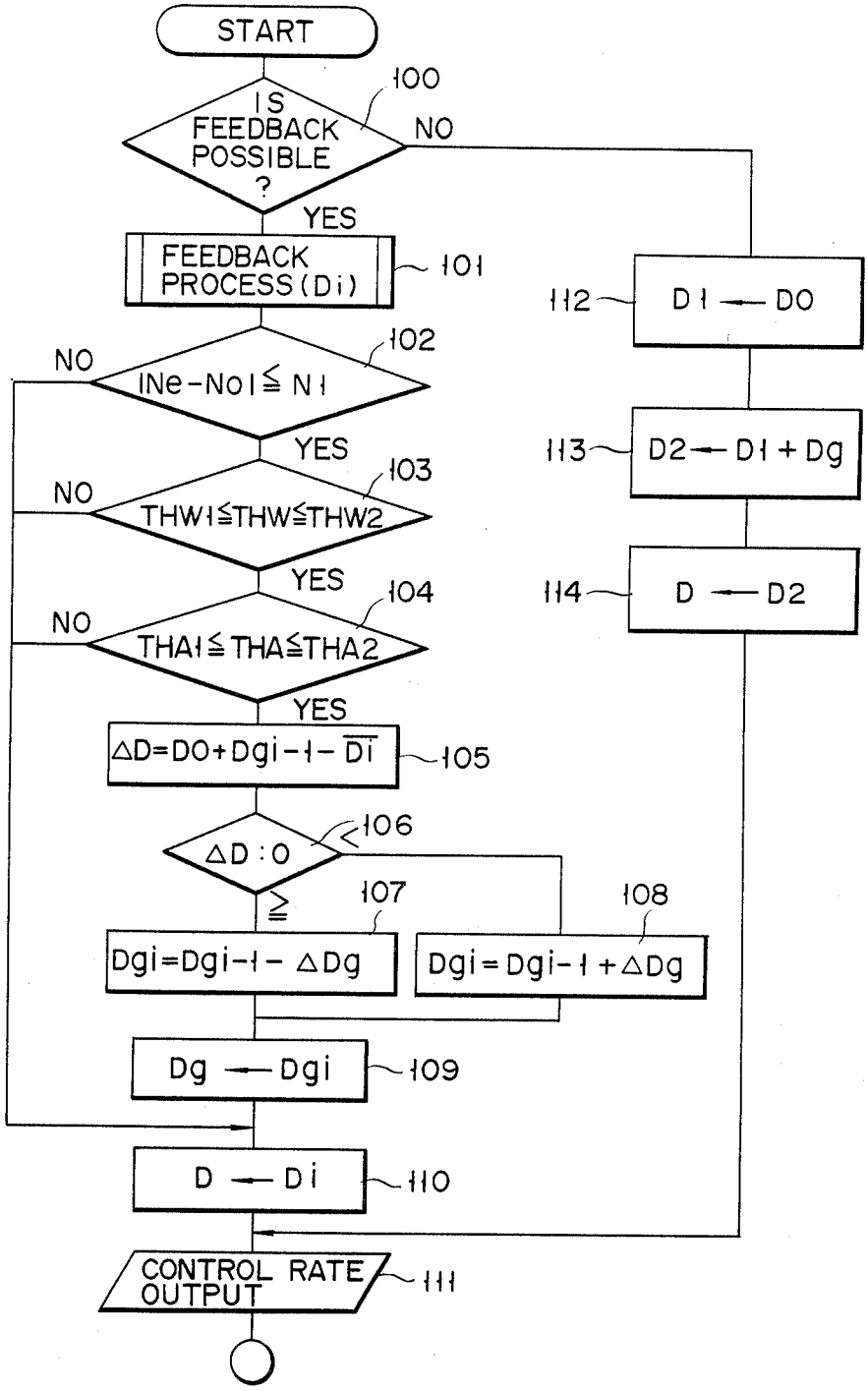
FIG. 5 is a flow chart for explaining the flow of the control state of the foregoing control circuit.

FIG. 5 shows an example of the processing routine for control of the idle operation which is executed for every constant time in the microcomputer constituting the control circuit 33, for instance, for every 10 mS. First, in step 100, a check is made to see if the feedback condition to feedback control an actual idle rotating speed $N_e$ to an objective rotating speed $N_0$ is satisfied or not. In this case, the objective rotating speed $N_0$ is preset in correspondence to the temperature of the cooling water. The feedback condition in step 100 is that the opening of the throttle valve 22 and the rotating speed of the engine 11 are both values below set values.

In the case where it is determined in step 100 that the feedback condition is satisfied, step 101 follows and a control amount $D_i$ at this time is obtained to perform the feedback control so that the actual idle rotating speed $N_e$ of the engine 11 becomes the objective rotating speed $N_0$. In other words, the process content in step 101 is such that the deviation between the actual rotating speed $N_e$ of the engine 11 and the objective rotating speed $N_0$ is derived and when the rotating speed $N_e$ is larger than the objective rotating speed $N_0$, only the set value which is read out from the map which has been preliminarily set in correspondence to the foregoing deviation value is subtracted from a control amount $D_{i-1}$ stored in the RAM 63 as a control amount D derived by this processing routine at the previous time, thereby obtaining the control amount $D_i$ at this time. On the contrary, when the actual rotating speed $N_e$ is smaller than the objective rotating speed $N_0$, the set value which is likewise read out from the map in correspondence to its deviation is added to the previous control amount $D_{i-1}$, thereby obtaining the control amount $D_i$ at this time. The actual rotating speed $N_e$ is obtained by count-processing the rotation angle signal which is generated from the rotation angle sensor 40.

Steps 102 and 104 are steps to discriminate whether the learning operations are executed or not. In step 102, a check is made to see if the deviation between the actual rotating speed $N_e$ and the objective rotating speed $N_0$ lies within a set value $N_1$ or not. When it is determined that the deviation is $N_1$ or less, the next step 103 follows. In step 103, a check is made to see if a water temperature THW detected by the cooling water temperature sensor 38 lies within a range from a set value $THW_1$ to a set value $THW_2$ or not. In this case, the set values of the cooling water temperature are set such that $THW_1 = 80°$ C. and $THW_2 = 90°$ C. When it is determined that the temperature of the cooling water lies within the above-mentioned set values including these values, the step 104 follows.

Namely, in step 103, it is determined that the temperature of the exciting coil 29 of the air control valve becomes the specified temperature due to the cooling water and the resistance value of the exciting coil 29 becomes a predetermined value.

In step 104, a check is made to see if an intake air temperature THA which is detected by the intake air temperature sensor 30 lies within a range which is defined by set values $THA_1$ and $THA_2$ or not. For instance, the set value $THA_1$ is 30° C. and $THA_2$ is 50° C. When it is determined that the intake air temperature THA lies within the above-mentioned range including those set values, the next step 105 follows. In step 104, consideration is made for the exciting coil 29 of the air control valve 24 being heated or cooled due to the intake air.

Subsequent steps 105 to 109 are a processing routine which is executed in the case where it is determined in the foregoing steps 102 to 104 that the temperature of the exciting coil 29 of the air control valve 24 is the predetermined temperature and its resistance value is the predetermined value. In this processing routine, the learning operations corresponding to various kinds of time changes are executed.

First, in step 105, a mean value $\overline{D_i}$ of the control amount $D_i$ derived in step 101 is subtracted from the added value of the preset reference control amount $D_0$ and a learning value $D_{g-1}$ derived by this learning value operating routine at the previous time which has been stored as a learning value $D_g$, thereby obtaining the difference $\Delta D$. The foregoing reference control amount $D_0$ is obtained due to the experiment in the condition whereby the time change is not considered and it is set in correspondence to the temperature of the cooling water or the like. In addition, the mean value $\overline{D_i}$ of the control amount $D_i$ is the average value of the control amounts which are derived due to the processes of this routine, for example, from the previous time to the ten times before that process.

In the next step 106, a check is made to see if the sign of the difference $\Delta D$ derived in step 105 is positive or negative. In the case of "$\Delta D \geqq 0$", step 107 follows and a predetermined correction value $\Delta D_g$ is subtracted from the learning value $D_{gi-1}$ obtained in the previous learning value operating routine, thereby obtaining a learning value $D_{gi}$ at this time. On the contrary, when it is determined that "$\Delta D \geqq 0$" in step 106, step 108 follows and the correction value $\Delta D_g$ is added to the foregoing previous learning value $D_{gi-1}$ to obtain the learning value $D_{gi}$ at this time. The learning value $D_{gi}$ at this time obtained in steps 107 and 108 is stored as the new learning value $D_g$ into a predetermined address in the RAM 63 in step 109. Then, this learning value operating routine is finished.

In the next step 110, the control amount $D_i$ at this time derived in step 101 is stored as the control amount D into a predetermined address in the RAM 63.

In steps 102 to 104, when it is determined to be "NO" in the discriminating routine regarding whether the learning value operating process is executed or not, the learning value operating routine in steps 105 to 109 is skipped and the processing routine advances to step 110. In step 111, the process to output the control amount D to the drive circuit 42 is executed.

In the case where it is determined in step 100 that the feedback condition is not satisfied, the process for the open loop control is executed in steps 112 to 114. Namely, in step 112, the reference control amount $D_0$ which has been preset in correspondence to the cooling water temperature or the like is derived and this is set to a reference control amount $D_1$ at this time. In the next step 113, the learning value $D_g$ which was calculated and stored in the feedback control that had been performed until immediately before this open loop control is executed and the reference control amount $D_1$ at this time derived in the foregoing step 112 are added, thereby obtaining an addition control amount $D_2$. In the next step 114, the addition control amount $D_2$ derived in step 113 is stored as the new control amount D into a predetermined address in the RAM 63 and the processing routine advances to step 111. The process to output this control amount D to the drive circuit 42 is executed. Then, this open loop control routine is finished.

In such an open loop control routine, in step 113, the learning value $D_g$ derived in the learning value operating routine in the feedback control routine is reflected. Therefore, this makes it possible to prevent the rapid change in the control amount in the transient state upon switching between the open loop control and the feedback control. Namely, even in the event that the switching is performed between the feedback control and the open loop control, the rotating state of the engine 11 can be smoothly controlled.

In the foregoing embodiment, in steps 103 and 104 to discriminate whether the learning value operation is executed or not, the cooling water temperature and intake air temperature are used; however, consideration may be made of the influence by the temperature of the engine 11. Practically speaking, a temperature sensor 41 is provided to detect the temperature of the engine 11. A detection signal from this sensor 41 is also processed similarly in steps 103 and 104, thereby discriminating whether the learning value operating routine is executed or not.

In the routine described with reference to FIG. 5, the processing routine advances to step 107 or 108 in dependence upon the result of discrimination with respect to whether the sign of the difference $\Delta D$ is positive or negative. However, to execute the control with a higher degree of accuracy, the magnitude of the absolute value of $\Delta D$ is checked, and the sign of $\Delta D$ positive or negative, is checked in the foregoing step 106, thereby allowing the learning value to be operated in correspondence to the results of these discriminations.

Figure 6:
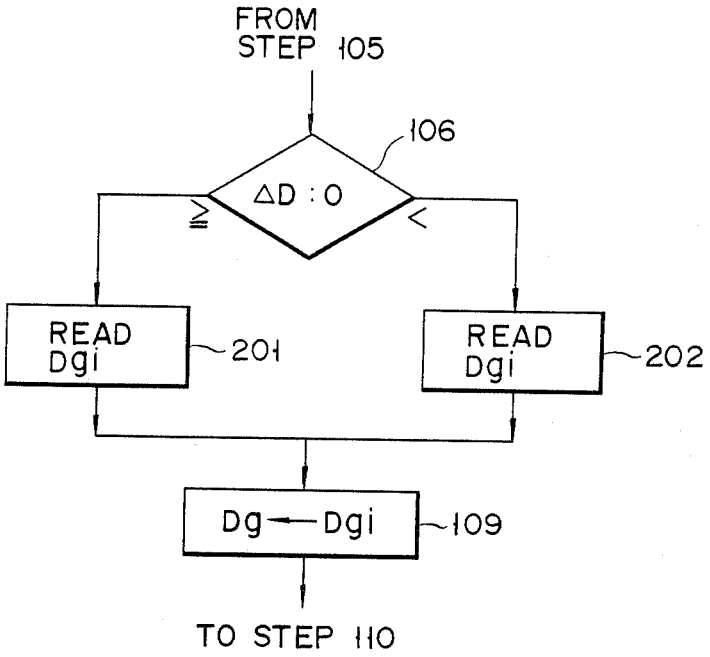
FIG. 6 is a flow chart for explaining another example of discrimination to see if the learning value operating routine is executed or not.

Namely, the processing routine advances to step 201 or 202 in dependence upon the result of discrimination in step 106 as shown in FIG. 6. In these steps 201 and 202, the correction value $D_{gi}$ of the learning value corresponding to the absolute value of the foregoing $\Delta D$ is read out from a preset map on the basis of the magnitude of the absolute value of $\Delta D$, thereby allowing the operation of the learning value $D_{gi}$ to be executed. By executing such processes, the difference $\Delta D$ rapidly approaches 0, so that the suitable learning control corresponding to the state of the engine is executed.

On the other hand, a description has been made in such a way that the temperatures of the cooling water and intake air were used as means for discriminating the temperature of the exciting coil 29 of the air control valve 24. However, as shown in FIG. 3, it is also possible to provide a temperature detecting sensor 56 which is constituted by a thermistor or the like for the air control valve 24 and thereby to supply a detection signal from this sensor 56 to the control circuit 33 as temperature data of the exciting coil 29. The processes corresponding to steps 103 and 104 in FIG. 5 are executed by use of this temperature data of the exciting coil 29 which is directly measured, thereby discriminating to see if the learning value operating routine is executed or not.

What is claimed is:

1. A control apparatus of an intake air amount in an internal combustion engine comprising:

a bypass air passageway which is arranged in parallel to an intake pipe to lead the intake air into the internal combustion engine, said bypass air passageway being formed to bypass a throttle valve portion of said intake pipe;

an air control valve having an actuator to control the amount of air flowing through said air passageway and an exciting coil to drive and control said actuator in accordance with an amount of an exciting current;

drive means for generating a pulse-like drive current which is controlled due to its duty ratio and supplying said drive current to the exciting coil of said air control valve;

temperature detecting means for detecting temperature information corresponding to a temperature of the exciting coil of said air control valve;

calculation storage means for calculating and storing a correction value of an amount of feedback control to allow the present rotating speed of said internal combustion engine in its idle state to approach an idle objective rotating speed in the states whereby a feedback control condition was set and whereby a value of the temperature information detected by said temperature detecting means lies within a specified temperature range, said stored correction value being used for calculation of a control amount upon open loop control; and control means for setting the duty ratio of the pulse-like drive current which is generated by said drive means in accordance with said control amount for said feedback control and open loop control, thereby controlling the amount of the air which flows through said bypass air passageway.

2. An apparatus according to claim 1, wherein said air control valve is constituted by an exciting coil in a housing and an actuator consisting of a plunger which is driven in the state whereby said exciting coil is excited by the exciting current in accordance with an amount of said exciting current, and the outer peripheral portion of said housing is formed with a cooling water passageway into which the cooling water of said internal combustion engine is led, thereby causing the temperature of said exciting coil to be influenced by said cooling water.

3. An apparatus according to claim 1, wherein a temperature detecting sensor to detect the temperature of said exciting coil is attached to said air control valve, and said temperature detecting means is constituted by this sensor.

4. An apparatus according to claim 1, wherein a cooling water passageway into which the cooling water of said internal combustion engine is led and circulated is formed in a housing portion of said air control valve, and at the same time a cooling water temperature sensor to detect the temperature of said cooling water is provided for said internal combustion engine, and said temperature detecting means is constituted by said cooling water temperature sensor.

5. An apparatus according to claim 1, wherein said temperature detecting means includes means for detecting the temperature of the exciting coil of said air control valve and means for detecting the temperature of the intake air which is supplied into the internal combustion engine, and the correction value of the control amount is calculated by said calculation storage means in the state whereby the temperatures of said exciting coil and intake air fall within specified ranges.

6. A control apparatus for the intake air amount in an internal combustion engine comprising:

an intake pipe;

a bypass air passageway which is arranged in parallel to said intake pipe to lead the intake air into the internal combustion engine, said bypass air passageway being formed to bypass a throttle valve portion of said intake pipe;

an air control valve having an actuator to control the amount of air flowing through said air passageway;

an exciting coil to drive and control said actuator in accordance with the amount of an exciting current;

means for heating the exciting coil of said air control valve, said heating means forming a cooling water passageway into which the cooling water of said internal combustion engine is circulated to said air control valve and the temperature of said exciting coil being set by the temperature of said cooling water;

drive means for generating a pulse-like drive current which is controlled due to its duty ratio and supplying said drive current to the exciting coil of said air control valve;

temperature detecting means for detecting the temperature of at least one of said cooling water and said intake air into the internal combustion engine;

calculation storage means for calculating and storing a correction value of an amount of feedback control to allow the present rotating speed of said internal combustion engine in its idle state to approach an idle objective rotating speed in the states whereby a feedback control condition was set and whereby a value of at least one of the temperatures of said cooling water and intake air detected by said temperature detecting means lies within a specified temperature range, said stored correction value being used for calculation of a control amount upon open loop control; and control means for setting the duty ratio of the pulse-like drive current which is generated by said drive means in accordance with said control amount for said feedback control and open loop control, thereby controlling the amount of air which flows through said bypass air passageway.

7. An apparatus according to claim 6, wherein said air control valve is constituted by an exciting coil in a housing and an actuator consisting of a plunger which is driven in the state whereby said exciting coil is excited by the exciting current in accordance with the amount of said exciting current, and the outer peripheral portion of said housing is formed with the cooling water passageway into which the cooling water of said internal combustion engine is led, thereby causing the temperature of said exciting coil to be influenced by said cooling water.

8. An apparatus according to claim 6, wherein said cooling water passageway into which the cooling water of said internal combustion engine is led and circulated is formed in a housing portion of said air control valve, and at the same time a cooling water temperature sensor to detect the temperature of said cooling water is provided for said internal combustion engine, and said temperature detecting means is constituted by said cooling water temperature sensor.

* * * * *